US009993122B2

(12) United States Patent
Bowen et al.

(10) Patent No.: US 9,993,122 B2
(45) Date of Patent: Jun. 12, 2018

(54) ROLLED SHEET PRODUCT DISPENSER

(71) Applicant: Kohler Co., Kohler, WI (US)

(72) Inventors: Stephen James Bowen, Shebogyan, WI (US); Niels J. Eilmus, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 363 days.

(21) Appl. No.: 14/968,526

(22) Filed: Dec. 14, 2015

(65) Prior Publication Data

US 2016/0174780 A1 Jun. 23, 2016

Related U.S. Application Data

(60) Provisional application No. 62/093,808, filed on Dec. 18, 2014.

(51) Int. Cl.
*A47K 10/38* (2006.01)

(52) U.S. Cl.
CPC ..... *A47K 10/3836* (2013.01)

(58) Field of Classification Search
CPC ..... A47K 10/3836
USPC ..... 242/597.7
See application file for complete search history.

(56) References Cited

U.S. PATENT DOCUMENTS 2,895,691 A * 7/1959 Toler ..... A47F 5/04 242/125.2
4,030,676 A * 6/1977 Bardsley ..... A47K 10/3836 242/419
4,248,391 A * 2/1981 Ness ..... A47K 10/3836 242/134
5,467,956 A * 11/1995 Herr ..... A47K 10/3836 211/16
6,443,388 B1 * 9/2002 Hollinger ..... A47K 10/38 242/591
7,140,573 B1 * 11/2006 Jerstroem ..... A47K 10/3836 242/597.3
7,401,749 B2 * 7/2008 Yang ..... B65H 16/04 242/597.7
7,419,118 B1 * 9/2008 Cooper ..... A47K 10/3836 242/597.7
7,458,541 B1 * 12/2008 Chang ..... A47K 10/3836 242/591
7,530,525 B2 * 5/2009 Yang ..... A47K 10/3836 242/597.3
7,543,776 B2 * 6/2009 Kurzyniec ..... B65D 85/04 242/423
7,559,504 B2 * 7/2009 Yang ..... A47K 10/3836 242/422.4
8,128,018 B2 * 3/2012 Shek ..... A47K 10/3836 242/564.4

(Continued)

*Primary Examiner* — William E Dondero
*Assistant Examiner* — Mark K Buse
(74) *Attorney, Agent, or Firm* — Foley & Lardner LLP

(57) ABSTRACT

A dispenser for rolled sheet products includes a base and a spindle. The base includes a top surface that extends downward from an outer peripheral portion of the base toward a center portion of the base to define a frusto-conical shape. The spindle is coupled to the center portion of the base and is configured to support a rolled sheet product along a longitudinal direction. The top surface of the base is configured to engage a lower edge of an outermost sheet of the rolled sheet product to prevent the outermost sheet from unraveling.

20 Claims, 5 Drawing Sheets

(56) References Cited

U.S. PATENT DOCUMENTS

2008/0061186 A1* 3/2008 Nip ..... A47K 10/3836
242/597.7

* cited by examiner

ROLLED SHEET PRODUCT DISPENSER

CROSS-REFERENCE TO RELATED APPLICATIONS

This application claims the benefit of and priority to U.S. Provisional Application No. 62/093,808, filed Dec. 18, 2014, the entire contents of which are incorporated by reference herein.

BACKGROUND

This disclosure relates generally to holders or dispensers for rolled sheet products, and more particularly relates to a dispenser for preventing unraveling of rolled sheet products which are wound around a tube, such as paper towels or toilet paper.

For convenient storage and access, many sheet materials are wound around tubes (e.g., plastic packing material, fabric, foil, and wrapping paper). Rolled paper products, such as paper towels and toilet paper, are commonly used in many applications, including commercial bathrooms, residential kitchens, and industrial laboratories. Simple and reliable dispensing of rolled paper products is desirable since they are relied on to both clean and contain waste. Additionally, because of their frequent use, rolls of paper products need to be easily replaceable with new rolls.

There is a need for an improved holder or dispenser for rolled sheet products that can, among other things, prevent unraveling of the sheet products. These and other advantageous features will become apparent to those reviewing the present disclosure.

SUMMARY

One embodiment relates to a dispenser for rolled sheet products. The dispenser includes a base and a spindle. The base includes a top surface that extends downward from an outer peripheral portion of the base toward a center portion of the base to define a frusto-conical shape. The spindle is coupled to the center portion of the base and is configured to support a rolled sheet product along a longitudinal direction. The top surface of the base is configured to engage a lower edge of an outermost sheet of the rolled sheet product to prevent the outermost sheet from unraveling.

Another embodiment relates to a rolled sheet product dispenser including a base and a spindle. The spindle is coupled at a middle portion of the base and is oriented in a substantially vertical direction. The base includes an upper portion defined by a plurality of concentric shelves that extend gradually downward from an outer periphery of the base toward the spindle.

Yet another embodiment relates to a dispenser for rolled sheet products. The dispenser includes a base and a spindle. The base includes an upper portion defined by a plurality of concentric shelves arranged at gradually decreasing heights from an outer periphery of the base toward a center of the base. The spindle is coupled to the center of the base and is configured to support a rolled sheet product along a longitudinal direction. Each of the concentric shelves is configured to engage a lower edge of an outermost sheet of the rolled sheet product to prevent the outermost sheet from unraveling.

DETAILED DESCRIPTION

Referring generally to the figures, disclosed herein are rolled sheet product dispensers that can prevent undesired unraveling of a rolled sheet product and can provide simple and reliable dispensing of rolled sheet products (e.g., paper towels, toilet paper, etc.).

Figure 1:
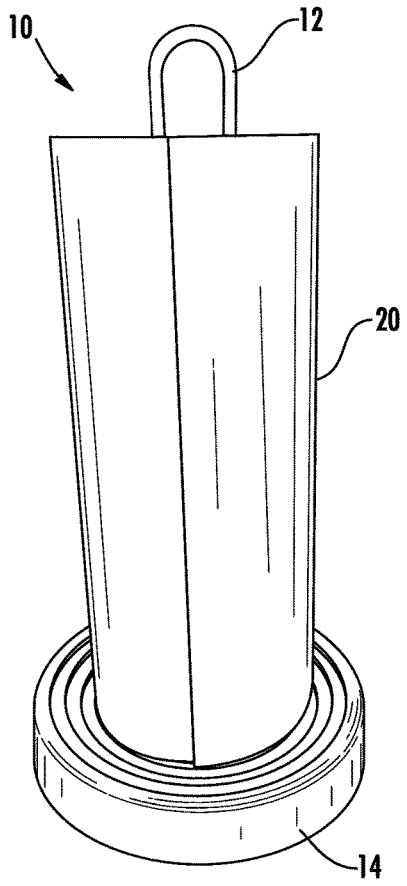
FIG. 1 is a perspective view of a rolled sheet product dispenser including a rolled sheet product disposed thereon according to an exemplary embodiment.
Figure 2:
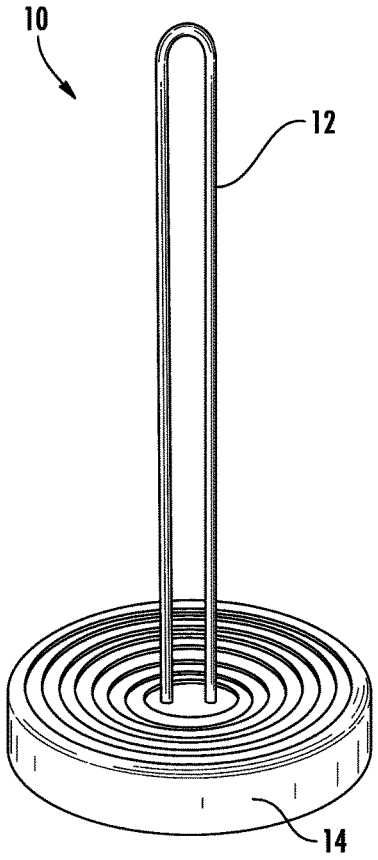
FIG. 2 is a perspective view of the rolled sheet product dispenser of FIG. 1 without a rolled sheet product disposed thereon.

Referring to FIGS. 1 and 2, a rolled sheet product dispenser 10 is shown with a rolled sheet product 20 disposed thereon (see FIG. 1) and without a rolled sheet product 20 disposed thereon (see FIG. 2), according to an exemplary embodiment. The rolled sheet product 20 is shown as a roll of paper towel in FIG. 1, although the rolled sheet product 20 may be any product or material in planar sheet form, such as fabric, plastic-wrap, wrapping paper, aluminum foil, toilet paper, or any other sheet product that is rolled around a tube, according to various exemplary embodiments (e.g., a cardboard tube, etc.). The rolled sheet product 20 may be rolled around a tube that may be cylindrical. The rolled sheet product 20 may include flat ends and may have a cylindrical shape. The flat ends may be defined by the circular end of the tube on which the rolled sheet product 20 is rolled. The flat ends of the tube may be flush with the edges of multiple rolled layers of the sheet product, as is typically the case with most conventional rolled sheet products.

According to an exemplary embodiment, the dispenser 10 may be disposed on a counter-top, a table top, a bracket, a floor, a base, or any other support surface, to thereby allow a user to access the dispenser 10 and the rolled sheet product 20 disposed thereon. The dispenser 10 can, advantageously, prevent undesired unraveling or unrolling of the rolled sheet product 20 due to its structural configuration, the details of which are discussed in the paragraphs that follow.

Figure 3:
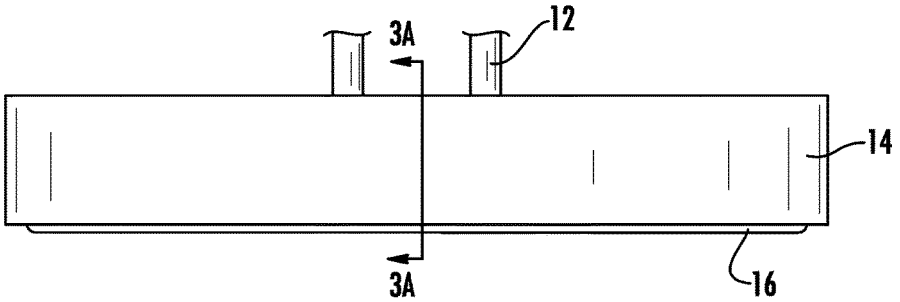
FIG. 3 is a partial front view of the rolled sheet product dispenser of FIG. 2.
Figure 3A:
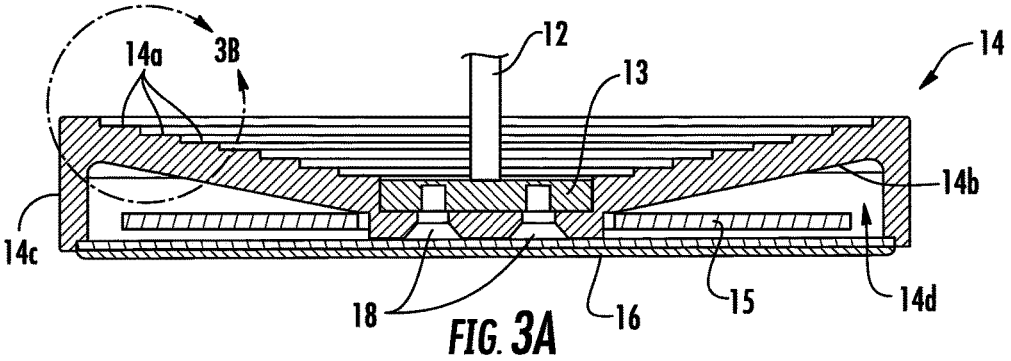
FIG. 3A is a partial cross-sectional view of the rolled sheet product dispenser of FIG. 3 taken along line 3A-3A.

As shown in FIGS. 2-3A, the dispenser 10 includes a spindle 12 (e.g., an upper member, a rod, an extension, etc.), a base 14 (e.g., a bottom member, etc.), a weight 15 (e.g., a disc member, etc.), a pair of fasteners 18 (e.g., screws, bolts, etc.), and a bottom member 16 (e.g., a grip, a cover, etc.), according to an exemplary embodiment.

Figure 2A:
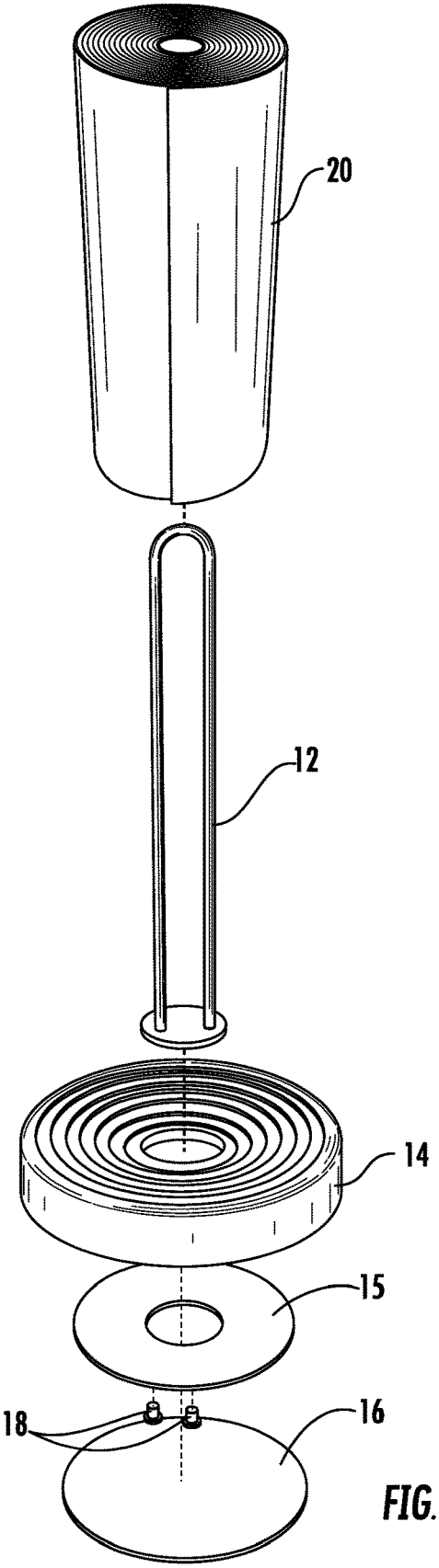
FIG. 2A is an exploded view of the rolled sheet product dispenser of FIG. 2 with a rolled sheet product.

According to the exemplary embodiment shown in FIGS. 2A and 3A, the spindle 12 is removably coupled to the base 14 via one or more fasteners 18. According to other exemplary embodiments, the spindle 12 is removably coupled to the base 14 via a press-fit interface with the base 14, without the need for any fasteners. According to other exemplary embodiments, the spindle 12 is fixedly coupled to the base 14 (e.g., over-molded, etc.). The spindle 12 can support the rolled sheet product 20 along a longitudinal direction relative to the base 14 (see, for example, FIG. 1). The rolled sheet product 20 can be rotated by a user relative to the spindle 12, so as to unroll the rolled sheet product 20 to retrieve or access a portion of the rolled sheet product for use. The spindle 12 is coupled to the base 14 at about a 90° angle, such that from a side view, the dispenser 10 has a T-shape appearance with the spindle 12 oriented in a substantially vertical direction.

According to the exemplary embodiment shown in FIGS. 1-3A, the base 14 has a generally cylindrical shape and a diameter that is generally larger than the diameter of the rolled sheet product 20 disposed thereon (see, for example, FIG. 1). In this way, the base 14 substantially surrounds a lower portion of the rolled sheet product 20. According to other exemplary embodiments, the base 14 may be any other shape and/or may have a general width and/or diameter sufficient to surround the lower portion of the rolled sheet product 20. According to the exemplary embodiment shown in the figures, the base 14 has an outer diameter of about 7.25 inches, although the base 14 may have a different outer diameter, according to other exemplary embodiments. According to an exemplary embodiment, the base 14 has a height sufficient to protect the rolled sheet product 20 from being exposed to liquids or other debris that may be on a support surface located near the dispenser 10. The height of the base 14 may also be sufficient to provide clearance for the one or more fasteners 18 for coupling the spindle 10 to the base and/or the weight 15, which may be located beneath an upper portion or top surface of the base 14.

Still referring to FIGS. 2A-3B, the base 14 has an upper portion or top surface that generally has a frusto-conical shape defined by a plurality of concentric shelves 14*a*. The plurality of concentric shelves 14*a* are arranged such that an outermost shelf is located at a height that is higher than a height of an inner, adjacent shelf located closer to the center of the base 14. That is to say, each of the concentric shelves 14*a* defines a level or step (e.g., section, region, layer, etc.) each having a different height that gradually decreases or extends downward from an outermost edge of the base 14 to a center portion of the base 14. This reduction in heights defines the generally frusto-conical shape of the upper portion or top surface of the base 14. The frusto-conical upper portion or top surface can, advantageously, urge the rolled sheet product 20 toward the center of the base 14 to prevent unraveling of the rolled sheet product.

For example, one or more of the concentric shelves 14*a* can maintain engagement with a lower outer edge of the rolled sheet product 20 as the outer diameter of the rolled sheet product 20 decreases (e.g., due to unrolling of the rolled sheet product 20). Each of the concentric shelves 14a may substantially impede or prevent unraveling of a leading edge or free end of an outermost sheet of the rolled sheet product 20 by urging the free end to seat along a surface of the respective shelf. A vertical surface of a concentric shelf 14*a* can engage a lower portion of the outermost sheet of the rolled sheet product 20 to seat along the shelf, to thereby prevent unraveling of the rolled sheet product. The rolled sheet product 20 is also urged in a downward direction toward the base 14 to rest along one or more of the concentric shelves 14*a* by virtue of the weight of the rolled sheet product 20.

Figure 3B:
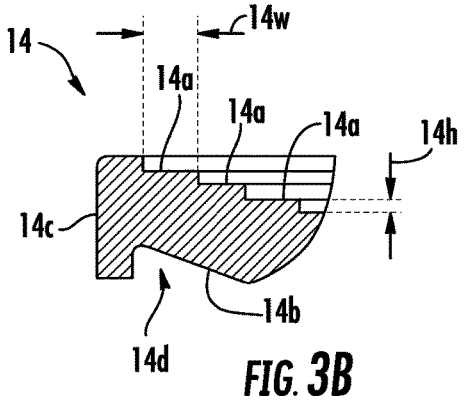
FIG. 3B is a detail view of the rolled sheet product dispenser of FIG. 3A.

As shown in FIG. 3B, the concentric shelves 14*a* are each defined by a generally horizontal surface and a generally vertical surface. The generally horizontal and vertical surfaces may be oriented at about a 90° angle relative to each other. The orientation of the horizontal and vertical surfaces of the concentric shelves 14*a* defines a generally frusto-conical shape of the base 14, resembling concentric stairs that gradually step down toward the spindle 12. According to the exemplary embodiment shown in FIG. 3B, the base 14 includes seven concentric shelves 14*a*, although the base 14 may have any number of concentric shelves 14*a*, according to other exemplary embodiments. Each of the concentric shelves 14*a* is defined by a horizontal surface having a width 14*w* and a vertical surface having a height 14*h*. According to an exemplary embodiment, the width 14*w* is larger than the height 14*h* to allow either of the flat ends of the rolled sheet product 20 to rest on one or more of the concentric shelves 14*a*.

According to the exemplary embodiment shown in figures, the width 14*w* is about 0.3286 inches and the height 14*h* is about 0.0464 inches. According to other exemplary embodiments, the horizontal and vertical surfaces of the concentric shelves 14*a* may have a different width and/or height. According to other exemplary embodiments, the horizontal and vertical surfaces of the concentric shelves 14*a* may each have the same width and/or height.

According to the exemplary embodiment shown in the figures, the concentric shelves 14a are formed integrally into the base 14. For example, the concentric shelves 14*a* may be formed in the base 14 by injection molding, poly resin casting, stainless steel stamping, cast zinc plating, or any other mode of formation. According to other exemplary embodiments, the concentric shelves 14*a* are formed separately from the base 14 and are coupled directly or indirectly to the base 14 (e.g., via fasteners, adhesive bonding, etc.).

The concentric shelves 14*a* can help to retain the rolled sheet product 20 on the base 14, and may prevent undesired unraveling of the rolled sheet product 20. For example, the vertical surface of a concentric shelf 14*a* located above the horizontal surface of the concentric shelf 14*a* on which the rolled sheet product 20 may be resting, can act to impede rotational movement of a free edge of an outermost sheet of the rolled sheet product 20, and may thereby prevent unraveling of the rolled sheet product.

In addition, the horizontal surface of each of the concentric shelves 14*a* may act as a support for the rolled sheet product 20. This support provided by each of the concentric shelves 14*a* may prevent undesired pressure on the lower edges of the outermost layers of the rolled sheet product 20, which may otherwise cause damage to the rolled sheet product 20, such as crinkling, scrunching, tearing, or wrinkling.

Still referring to FIGS. 2-3B, the base 14 includes an outer surface 14*c* surrounding the base 14, and an inner surface 14*b* defining an inner cavity 14*d* (e.g., undercut portion, opening, etc.). The outer surface 14*c* has a generally cylindrical shape and defines an outermost periphery of the base 14. The inner surface 14*b* is located opposite the plurality of concentric shelves 14*a*, and has an inverted frusto-conical shape to mimic the frusto-conical shape of the plurality of concentric shelves 14*a*. The inner surface 14*b* defines a recessed, middle portion or center that is generally flat and projects downward away from the concentric shelves 14*a*. The middle portion includes one or more openings for receiving one or more fasteners 18 therethrough for coupling the spindle 12 to the base 14. The inner surface 14*b* also defines a cavity 14*d* of the base 14 for receiving the weight 15, the fasteners 18, and a portion of the bottom member 16 therein. The cavity 14*d* also helps to minimize the amount of material used to form the base 14, and can minimize the overall weight of the base 14.

According to various exemplary embodiments, the base 14 is made of a rigid or a semi-rigid material or combinations of materials, such as plastic, wood, metal, rubber, stone, or any other material which may be sufficiently strong to support the weight of the spindle 12 and the rolled sheet product 20 thereon.

According to the exemplary embodiment of FIGS. 3-3A, the dispenser 10 also includes a bottom member 16 coupled to a bottom portion of the base 14. The bottom member 16 has a generally planar shape, such that the base 14 may be placed on a planar support surface to support the dispenser 10 via the bottom member 16 (e.g., a countertop, a tabletop, etc.). According to other exemplary embodiments, the bottom member 16 may include one or more legs or feet configured to substantially support the base 14 and the rolled sheet product 20 on a support surface. The legs may be configured to provide a level support surface such that the spindle 12 is oriented in a substantially upright direction when the dispenser 10 is placed on the planar support surface.

As shown in FIG. 3A, the bottom member 16 may be configured as a disc that is coupled to a bottom portion of the base 14, such that it conceals the inner cavity 14*d* defined by the inner surface 14*b*, and one or more of the components contained therein (e.g., fasteners 18, weight 15, etc.). According to various exemplary embodiments, the bottom member 16 is coupled to the base 14 with adhesive, integrally molded snap fittings, tongue-in-groove connectors, integral screw planes or threading, screws, bolts, or any other fastener sufficient to couple the bottom member 16 to the base 14. The bottom member 16 may be made of plastic, rubber, metal, or any other rigid or semi-rigid material or combinations of materials sufficient for the particular application of the bottom member 16.

According to an exemplary embodiment, the bottom member 16 may include an outer layer of an anti-slip material that can provide sufficient frictional resistance between the bottom member 16 and a support surface to prevent the dispenser 10 from moving relative to the support surface during, for example, use of the dispenser 10 (e.g., unrolling of the rolled sheet product 20). According to an exemplary embodiment, the anti-slip material is a layer of rubber, cork, a suction cup, or any other material or coating to provide sufficient frictional resistance for the dispenser 10 relative to a support surface. According to other exemplary embodiments, the entire bottom member 16 may be made of an anti-slip material (e.g., rubber, cork, etc.).

Still referring to FIGS. 2-3B, a weight 15 is disposed within the base 14. According to the exemplary embodiment shown, the weight 15 is sandwiched between the bottom member 16 and an interior portion of the base 14. According to other exemplary embodiments, the weight 15 is coupled directly to the base 14 (e.g., via fasteners, adhesive bonding, etc.). According to an exemplary embodiment, the weight 15 can help maintain an upright orientation of the dispenser 10 when, for example, a user is unrolling the rolled sheet product 20 from the dispenser 10. That is to say, the weight 15 can provide a downward force on the base 14, such that rotation of the rolled sheet product 20 by a user does not disturb the position/orientation of the dispenser 10 relative to a support surface. In this manner, the dispenser 10 can provide reliable and easy dispensing of rolled sheet products.

According to an exemplary embodiment, the weight 15 may be shaped such that it fits within the cavity 14*d* of the base 14. For example, the weight 15 may be a disc of smaller height and outer diameter than the outer diameter of the base 14. The weight 15 may include an opening located near the center of the disc for locating the weight 15 relative to the base 14. The opening can, advantageously, receive the middle portion of the base 14 defined by the inner surface 14*b* to locate the weight 15 along an axial direction relative to the base 14. According to various exemplary embodiments, the weight 15 may be made of a sufficiently solid and heavy material (e.g., steel or lead), such that the dispenser 10 may resist the force of a user pulling on the rolled sheet product 20 during unrolling of the rolled sheet product. According to an exemplary embodiment, the weight provides about 1.8 kg of additional weight to the base 14. According to other exemplary embodiments, the base 14 itself may be made of a sufficiently solid and heavy material, such as marble or cast iron, such that the dispenser 10 may resist the force of a user pulling on the rolled sheet product 20 without the need for an additional weight/component in the dispenser 10.

Figure 4:
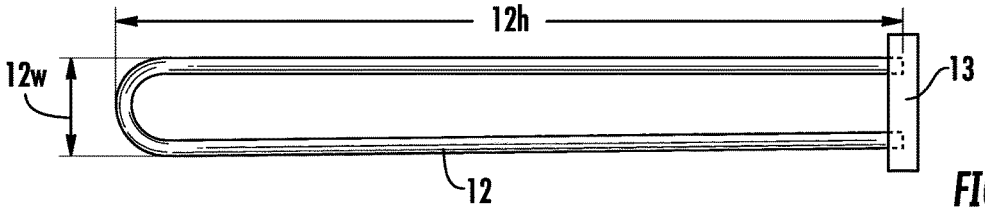
FIG. 4 is a front view of a spindle of a rolled sheet product dispenser according to an exemplary embodiment.

Referring to FIGS. 2-4, the dispenser 10 includes a spindle 12 removably coupled to the base 14 according to an exemplary embodiment. The spindle 12 is configured to receive the rolled sheet product 20 thereon, and to support the rolled sheet product 20 along a longitudinal direction. As shown in FIGS. 2 and 3A, the spindle 12 includes a member 13 disposed at an end thereof for coupling the spindle 12 to the base 14. According to an exemplary embodiment, the member 13 is integrally formed with the spindle 12 (e.g., overmolded, etc.). According to other exemplary embodiments, the member 13 is removably or fixedly coupled to the spindle 12. The member 13 has a generally planar, cylindrical shape, and is configured to be received within a centrally located recessed portion of the base 14 to couple the spindle to the base. The recessed portion of the base 14 is located at the center of the base 14 and is surrounded by the plurality of concentric shelves 14*a*.

As shown in FIGS. 2 and 3A, one or more fasteners 18 couple the spindle 12 to the base 14 via the member 13. For example, the member 13 may include one or more threaded holes disposed therein that can be aligned with one or more apertures formed through the middle portion of the base 14. One or more fasteners 18 can be inserted from an underside of the base 14 through the apertures of the base, and then threaded into the threaded holes of the member 13. In this way, the fasteners 18 can removably couple the spindle 12 to the base 14. According to an exemplary embodiment, the fasteners 18 are screws, bolts, or any other fastener suitable for coupling the spindle 12 to the base 14.

According to the exemplary embodiment shown in FIGS. 1-2A, the height of the spindle 12 may be about the same as the height of the rolled sheet product 20, such that when a user pulls on the rolled sheet product 20, the spindle 12 may retain the rolled sheet product 20 along a longitudinal direction on the dispenser 10. According to other exemplary embodiments, the spindle 12 may be multiple times the height of the rolled sheet product 20, such that the dispenser 10 may hold a plurality of rolls of rolled sheet products 20 thereon. The height of the spindle 12 may be limited such that a user may be able to reach the top and remove/replace the rolled sheet product 20 from a convenient position on a support surface.

According to an exemplary embodiment, the spindle 12 is a U-shaped rod comprising a 180° bend and two generally parallel tines. According to other exemplary embodiments, the spindle 12 may be any overall rod-shaped form, such as a solid cylinder or a wire turned to be double helix. The spindle 12 may have ornamentation disposed on it, including at its top. The spindle 12 may include a removable top or cap. The spindle 12 may have a constant width extending along a portion of or the entire length of the spindle. The maximum width of the spindle 12 may be generally smaller than the inner diameter of the tube on which the rolled sheet product 20 is rolled, so as to permit relative rotational movement between the rolled sheet product 20 and the spindle 12. The removable top of the spindle 12 may be wider than the maximum width of the of the spindle 10, so as to maintain a longitudinal position of the rolled sheet product 20 relative to the dispenser 10. The removability of the top of the spindle 12 may allow for the removal and replacement of empty and full tubes/rolls of rolled sheet product 20.

FIG. 4 illustrates the spindle 12 of the rolled sheet product dispenser 10 according to an exemplary embodiment. The spindle 12 may be made of a bent wire forming a U-shape with a width 12*w* and a height 12*h*. The wire of the spindle 12 may be stainless steel, for example, or any other suitable material. For example, in a dispenser 10 that may be configured as a paper towel holder, the wire of the spindle 12 may have a diameter of about 0.25 inches. The width 12*w* and the height 12*h* may be about 1.5 inches and about 13.5 inches, respectively, according to an exemplary embodiment. According to various exemplary embodiments, the spindle 12 may be made of metal, plastic, stone, or any other rigid or semi-rigid material or combinations of materials that can withstand the force of a user pulling on the rolled sheet product 20 during, for example, unrolling of the rolled sheet product 20.

According to an exemplary embodiment, the spindle 12 may be coupled directly to the base 14 by adhesive, welding, bolts, screws, brackets, tongue in groove connectors, plastic snap fittings or any other type of fastener that can withstand the force created by a user pulling the rolled sheet product 20 off of its tube. According to other exemplary embodiments, the spindle 12 and base 14 may be formed out of a single continuous and/or solid piece, such as ceramic or marble.

Figure 5:
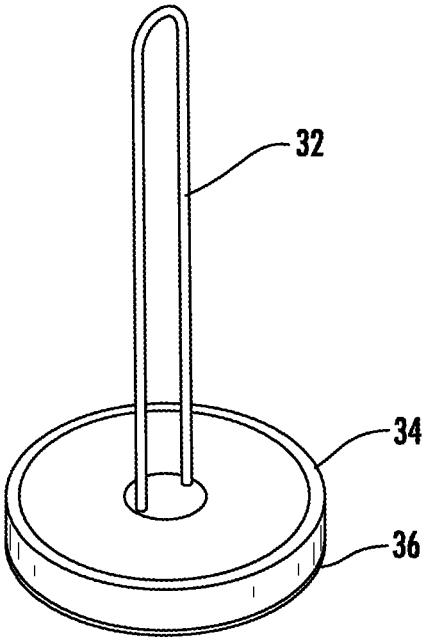
FIG. 5 is a perspective view of a rolled sheet product dispenser according to another exemplary embodiment.
Figure 5A:
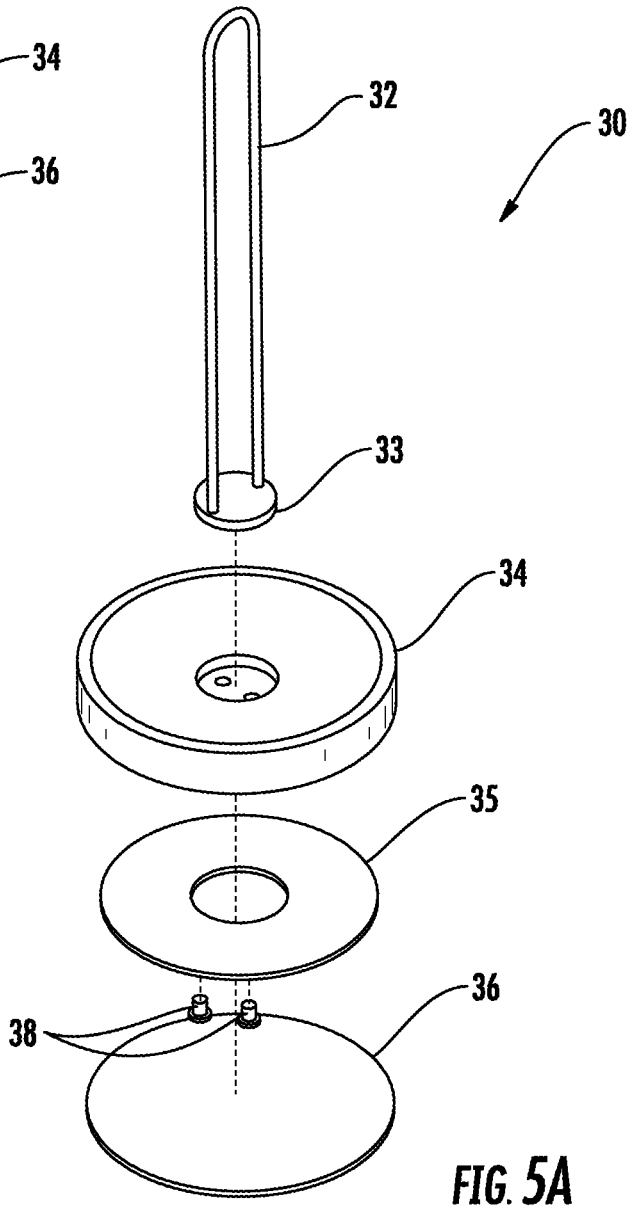
FIG. 5A is an exploded view of the rolled sheet product dispenser of FIG. 5.
Figure 6:
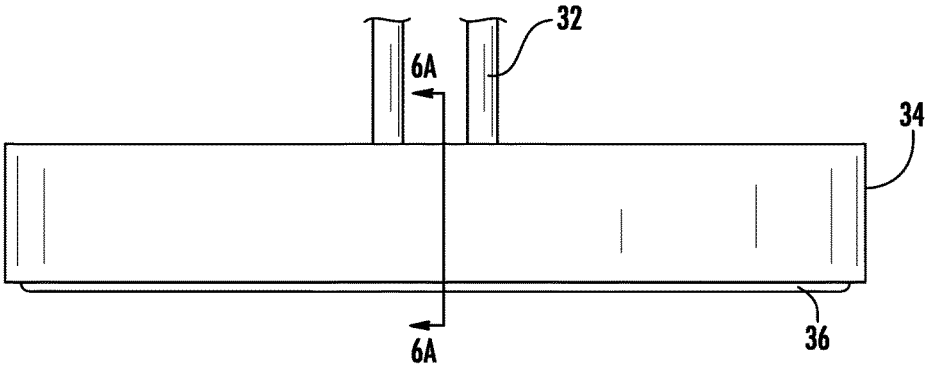
FIG. 6 is a partial front view of the rolled sheet product dispenser of FIG. 5.
Figure 6A:
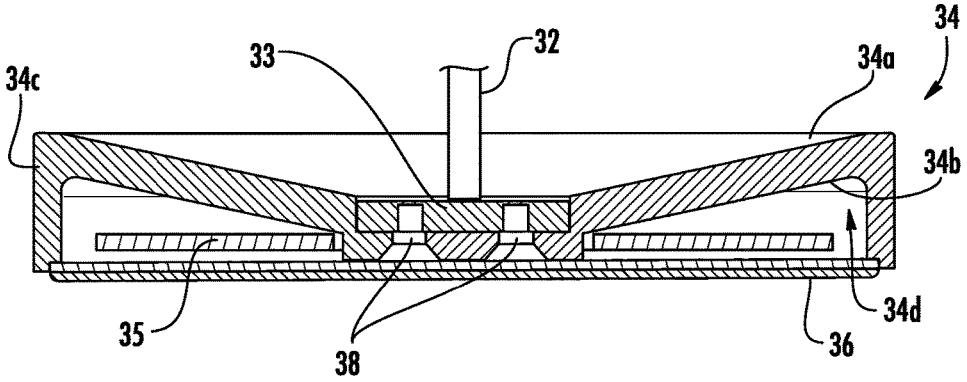
FIG. 6A is a partial cross-sectional view of the rolled sheet product dispenser of FIG. 6 taken along line 6A-6A.

Referring to FIGS. 5-6A, a rolled sheet product dispenser 30 is shown according to another exemplary embodiment, where like reference numerals refer to identical components between figures, but are increased by an order of three (e.g., base 14 of FIGS. 1-3B is base 34 in FIGS. 5-6A, etc.). As shown in FIGS. 5-6A, the base 34 is formed with an upper portion or top surface having a frusto-conical shape that slopes gradually downward toward the spindle 32. The upper portion is defined by an upper surface 34*a* that is generally smooth and slopes gradually downward toward the center of the base 34 to define a frusto-conical shape. The smooth, frusto-conical surface 34a can function as an anti-ravel feature for a rolled sheet product, such as the rolled sheet product 20 shown in FIGS. 1-2A. For example, the frusto-conical top surface 34*a* of the base 34 can substantially impede or prevent an outermost layer or sheet of the rolled sheet product from moving laterally at its lower edge, which may be in contact with the upper surface 34*a*.

As shown in FIGS. 5-6A, the upper surface 34*a* tapers gradually downward to the spindle 32 to define a frusto-conical surface. According to an exemplary embodiment, the angle of the slope of the upper surface 34*a* may be about 8° from horizontal, although the angle of the slope may be less than or greater than 8° according to other exemplary embodiments. In addition, the angle of the slope may vary along a radial distance from the center of the base 34 to provide a curved (e.g., arcuate, etc.) slope between an outer periphery of base 34 (e.g., outer surface 34*c*) and the center of the base 34.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A dispenser for rolled sheet products comprising:

a base including a top surface that extends gradually downward from an outer peripheral portion of the base toward a center portion of the base defining a frusto-conical shape; and a spindle coupled to the center portion of the base and configured to support a rolled sheet product along a longitudinal direction;

wherein the top surface surrounds a lower portion of the spindle and is configured to engage a lower edge of an outermost sheet of the rolled sheet product to prevent the outermost sheet from unraveling.

2. The dispenser of claim 1, wherein the top surface extends continuously from the outer peripheral portion of the base toward the center portion of the base.

3. The dispenser of claim 1, wherein the top surface is defined by a plurality of concentric shelves forming a stepped pattern that tapers gradually downward from the outer peripheral portion of the base toward the center portion of the base.

4. The dispenser of claim 1, wherein the base includes an inner surface located opposite the top surface and defining an inner cavity.

5. The dispenser of claim 4, further comprising a weight coupled to the base within the inner cavity.

6. The dispenser of claim 5, further comprising a bottom member coupled to a bottom portion of the base and configured to substantially conceal the inner cavity.

7. The dispenser of claim 6, wherein the bottom member includes an anti-slip layer disposed on an outer surface thereof, and wherein the anti-slip layer is configured to substantially impede sliding movement of the dispenser relative to a support surface.

8. The dispenser of claim 1, further comprising a member coupled to an end of the spindle, wherein the member includes an opening defined by an inner threaded portion.

9. The dispenser of claim 8, wherein the base includes a recess located at the center portion of the base configured to receive the member therein, and wherein the recess includes an aperture configured to be aligned with the opening of the member.

10. The dispenser of claim 9, further comprising a fastener disposed through the aperture of the base and threadably engaged with the inner threaded portion of the member.

11. A rolled sheet product dispenser comprising:

a base; and a spindle coupled at a middle portion of the base and oriented in a substantially vertical direction;

wherein the base includes an upper portion defined by a plurality of concentric shelves that surround a lower portion of the spindle and extend gradually downward from an outer periphery of the base toward the spindle.

12. The dispenser of claim 11, wherein each of the concentric shelves is defined by a vertical surface and a horizontal surface, wherein the horizontal surface has a width that is larger than a height of the vertical surface.

13. The dispenser of claim 11, wherein each of the concentric shelves is configured to prevent an outermost sheet of a rolled sheet product from unraveling.

14. The dispenser of claim 11, wherein the base includes an inner surface defining an inner cavity.

15. The dispenser of claim 14, further comprising a weight coupled to the base within the inner cavity.

16. The dispenser of claim 15, further comprising a bottom member coupled to a bottom portion of the base and configured to substantially conceal the inner cavity.

17. A dispenser for rolled sheet products comprising:

a base including an upper portion defined by a plurality of concentric shelves arranged at gradually decreasing heights from an outer periphery of the base toward a center of the base; and a spindle coupled to the center of the base and configured to support a rolled sheet product along a longitudinal direction;

wherein each of the concentric shelves surrounds a lower portion of the spindle and is configured to engage a lower edge of an outermost sheet of the rolled sheet product to prevent the outermost sheet from unraveling.

18. The dispenser of claim 17, wherein each of the concentric shelves is defined by a vertical surface and a horizontal surface, wherein the horizontal surface has a width that is larger than a height of the vertical surface.

19. The dispenser of claim 18, wherein the vertical surface is configured to urge the lower edge of the outermost sheet toward the center of the base.

20. The dispenser of claim 19, further comprising a weight provided within the base.

* * * * *